US005975091A

United States Patent [19]

Balanchi

[11] Patent Number: 5,975,091

[45] Date of Patent: Nov. 2, 1999

[54] SAFETY HANDLE FOR HAIR SETTING ROLLERS

[76] Inventor: Robert Balanchi, 3657 Gleneagle Dr., Tarzana, Calif. 91356

[21] Appl. No.: 09/303,752

[22] Filed: May 3, 1999

[51] Int. Cl.[6] ..... A45D 6/02

[52] U.S. Cl. ..... 132/237; 132/242; 132/266

[58] Field of Search ..... 132/237, 223, 132/226, 242, 245, 250, 261, 262, 266, 267, 238, 239, 123; 15/145, 176.1, 176.6

*Primary Examiner*—Gene Mancene
*Assistant Examiner*—Pedro Philogene
*Attorney, Agent, or Firm*—Gilbert Kivenson

[57] ABSTRACT

A contractile handle containing a longitudinal slot and a flexible grip is described. By the use of this handle heated hair curler rollers may be individually removed from a vat of boiling curling solution, strands of hair easily rolled around each roller, the handle removed and the process repeated the desired number of times. When all the rollers have cooled and dried, the handle is again used to unwind and remove the rollers one at a time. The now-curled strands then are lightly combed to combine individual curls.

2 Claims, 1 Drawing Sheet

SAFETY HANDLE FOR HAIR SETTING ROLLERS

BACKGROUND OF THE INVENTION AND GENERAL DESCRIPTION OF ITS OPERATION

A popular method for the curling and setting of women's hair is to use plastic rollers wetted with heated curling solution. The rollers are placed in a vat containing a heated curling solution. One roller is then removed from the vat, applied to a group of hair strands and spun to form a curl. Each roller has a fuzzy external surface to which the hair strands will adhere. The process is repeated to produce the number of curls desired. After the applied hair solution has cooled and dried, it is possible to unwind the rollers. The unwound curls will spring back and the hair is "set" in a wavy pattern. There are, however, several difficulties encountered in this process. It is easy to scald the fingers when handling a roller which has been immersed in a hot solution. It is also uncomfortable to turn the roller because of its rough surface. A partial remedy which has been used in the past to alleviate these problems is to provide the rollers with smooth end bands or caps. These bands or caps permit easier turning during the coiling the uncoiling process but the problem of working with the hot liquid remains.

The present invention is essentially a flexible tongs which is inserted into the hollow interior of a roller and locks in place. This facilitates the lifting of the individual rollers from the heated vat, the application of each roller to a strand of hair, the coiling and subsequent uncoiling and the removal of the rollers.

DETAILED DESCRIPTION

Figure 2:
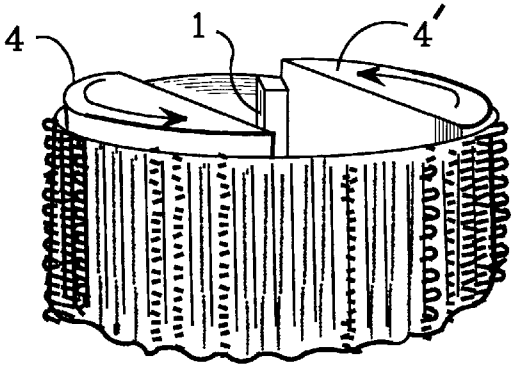
FIG. 2 is a partial isometric view of the end of the invention when mounted in a hair setting roller illustrating the manner in which the moveable fingers lock into the interior roller projection. This prevents rotational motion of the fingers with respect to the roller.
Figure 3:
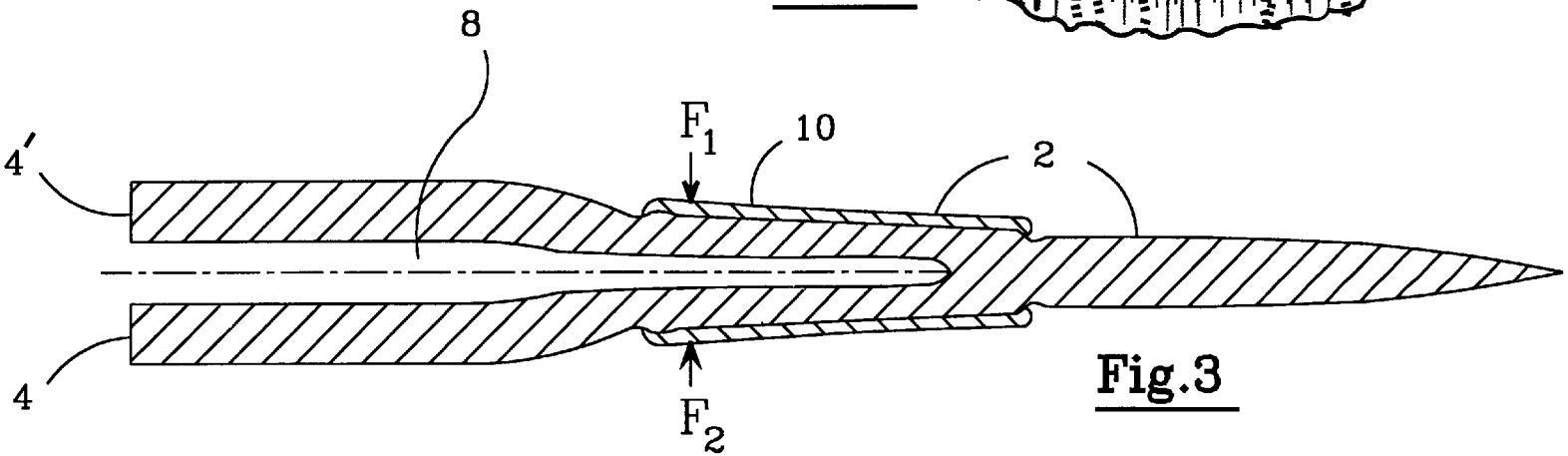
FIG. 3 is a cross sectional view of the invention taken across lines 3—3 of FIG. 1 with the roller removed showing how the flexible fingers are formed.

The invention will be described with references to FIGS. 1, 2 and 3. The semicylindrical fingers 4 and 4' are integral with the generally conical body 2 of the handle. A slot 8 cut into the body extends from its semicylindrical ends well into the conical portion and imparts flexibility to the structure. When pressure is applied to points $F_1$ and $F_2$ as shown in FIG. 3, the semi-cylindrical fingers 4 and 4' approach one another and reduce the diameter. This permits the handle to be inserted into a roller 5. Release of pressure causes the fingers to expand and contact the inner surface of the roller. Rotation of the handle before pressure release allows one end of the fingers to encounter the vertical bar 1 which is a stiffening piece molded into the plastic of the roller 5. This locks the roller (after pressure release) onto the handle and prevents rotational or longitudinal motion.

Figure 1:
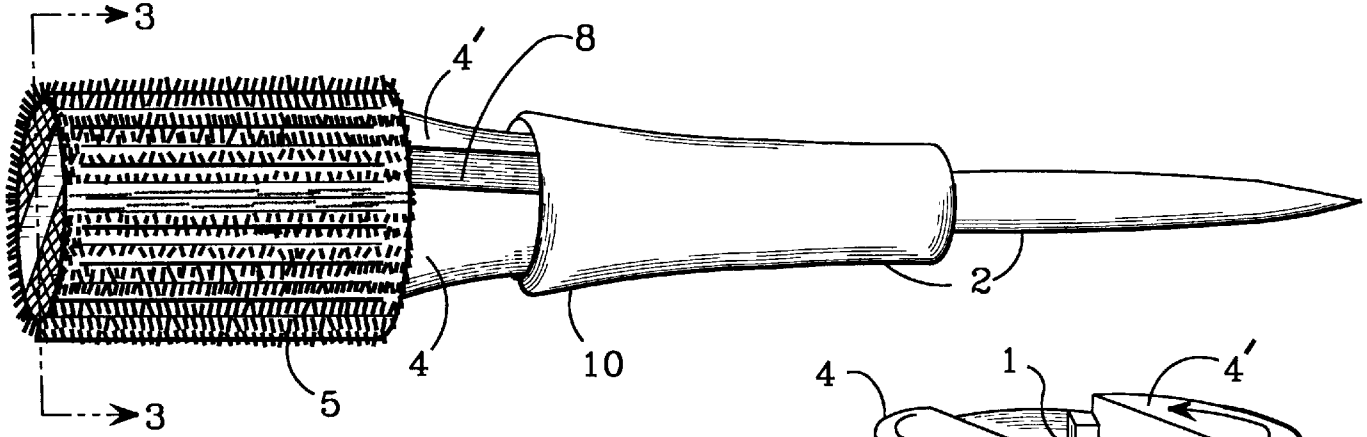
FIG. 1 is a perspective view of the invention inserted into a hair setting roller showing the invention's moveable fingers and its pliable comfort grip.

A resilient cover 10, as shown in FIGS. 1 and 3, is slipped over the handle to facilitate rotation of the handle when a hot roller is being applied to the hair and when the uncoiling operation is being carried out. Cover 10 prevents contact of the operator's fingers with slot 8. The cover is preferably made of a soft material such as rubber and is thin enough to transmit forces $F_1$ and $F_2$.

The invention can be provided in several diameters of its semi-cylindrical fingers to accommodate the various sizes of hair curling rollers commonly employed.

What is claimed is the following:

1. A handle for engaging a cylindrical hair curling roller comprising:

a. a generally conical body containing a longitudinal slot and terminating in a pair of semicylindrical ends;

b. a pliant cover fitting over a part of said slot; whereby pressure applied through said pliant cover, perpendicular to the slot, will flexibly force said semicylindrical ends together, permitting said ends to be inserted into a hair curling roller and release of pressure will allow the ends to flex back to their original spacing thus trapping the hair curling roller so as to permit handling of the roller with minimum of discomfort.

2. A handle for engaging a cylindrical hair curling roller as described in claim 1 which can facilitate the coiling and uncoiling of strands of hair by virtue of the extension afforded by said handle from said roller and the smooth continuous surface provided by said pliant cover.

* * * * *